US009161420B2

(12) United States Patent
Park

(10) Patent No.: US 9,161,420 B2
(45) Date of Patent: Oct. 13, 2015

(54) SYSTEM FOR CONTROLLING LIGHT IN WIRELESS MANNER

(71) Applicant: HANAM ARTEC CO., LTD., Uiwang-si, Gyeonggi-do (KR)

(72) Inventor: Jai-Han Park, Uiwang-si (KR)

(73) Assignee: HANAM ARTEC CO., LTD., Uiwang-Si, Gyeonggi-Do (KR)

( * ) Notice: Subject to any disclaimer, the term of this patent is extended or adjusted under 35 U.S.C. 154(b) by 0 days.

(21) Appl. No.: 14/507,067

(22) Filed: Oct. 6, 2014

(65) Prior Publication Data

US 2015/0163886 A1 Jun. 11, 2015

(51) Int. Cl.
*H05B 37/02* (2006.01)

(52) U.S. Cl.
CPC ..... *H05B 37/0272* (2013.01); *H05B 37/029* (2013.01)

(58) Field of Classification Search
CPC .. H05B 37/02; H05B 37/0272; H05B 37/038; H05B 37/029; H05B 41/38; H04B 10/116; H04B 10/54; Y02B 20/48
USPC ..... 315/307, 291, 294, 297, 312, 117, 318; 398/118, 128, 130
See application file for complete search history.

(56) References Cited

U.S. PATENT DOCUMENTS 5,838,116 A * 11/1998 Katyl et al. ..... 315/307
7,332,877 B2 * 2/2008 Crodian et al. ..... 315/297
8,138,690 B2 * 3/2012 Chemel et al. ..... 315/318
8,963,428 B2 * 2/2015 Kang et al. ..... 315/117
2005/0190078 A1 * 9/2005 Salter ..... 340/945
2008/0136334 A1 * 6/2008 Robinson et al. ..... 315/151

(Continued)

FOREIGN PATENT DOCUMENTS

JP 198733102 A 2/1987
JP H10328430 A 12/1998
JP 2009505346 A 2/2009

(Continued)

OTHER PUBLICATIONS

Japanese Office Action mailed Mar. 10, 2015 for corresponding Japanese Application No. 2014-150612, citing the above references.

(Continued)

*Primary Examiner* — Haissa Philogene
(74) *Attorney, Agent, or Firm* — Lowe Hauptman & Ham, LLP

(57) ABSTRACT

A system for controlling light in a wireless manner includes a plurality of lighting installations containing a control module configured to control a lighting's status and an input module input a command to the control module, and a control device configured to controlling the lighting installations by wireless communication via a plurality of communication channels with the lighting installations, wherein the control module operates as either a first mode that it is controlled by the control device or a second mode that it is controlled by the input module, the control device controls the plurality of lighting installations in accordance with lighting patterns by an input among a plurality of the lighting patterns, and the plurality of lighting installations contains a first lighting installation and a second lighting installation, and the first lighting installation controls the second lighting installation by sending signals through the command to the control device.

4 Claims, 8 Drawing Sheets

(56) References Cited

U.S. PATENT DOCUMENTS

| | | | | |
|---|---|---|---|---|
| 2015/0061545 | A1* | 3/2015 | Lee et al. | 315/307 |
| 2015/0098709 | A1* | 4/2015 | Breuer et al. | 398/118 |

FOREIGN PATENT DOCUMENTS

| | | | |
|---|---|---|---|
| JP | 2013004323 | A | 7/2013 |
| KR | 20100136378 | A | 12/2010 |
| KR | 20120027258 | A | 3/2012 |

OTHER PUBLICATIONS

Korean Office Action mailed Feb. 26, 2014 for corresponding Korean Application No. 10-2013-0153956, citing the above references.

* cited by examiner

SYSTEM FOR CONTROLLING LIGHT IN WIRELESS MANNER

CROSS-REFERENCE TO RELATED APPLICATION

This application claims the priority of the Korean Patent Application No. 2013-0153956 filed on Dec. 11, 2013 in the Korean Intellectual Property Office, and all the benefits accruing therefrom under 35 U.S.C. §119. The contents of the above-listed patent application in their entirety are herein incorporated by reference.

TECHNICAL FIELD

The present disclosure relates in some embodiments to a system for controlling light in a wireless manner, and more particularly, a system for controlling light in a wireless manner that controls a plurality of lighting installations and forms lighting patterns.

A lighting installation is a device for lighting by means of reflection, refraction and penetration of light from a light source. Sorted by light distribution, lighting installations are classified with five types, that is, indirect lighting installations, semi-indirect lighting installations, general diffuse lighting installations, semi-direct lighting installations and direct lighting installations.

A light emitting diode (LED), a lighting source having been widely used recently due to its ability to operate with low power, creates injected minority carrier by using a p-n junction of a semiconductor, and lighting is emitted by reunion of those minority carriers. Since such LEDs not only are in compact size compared to the existing lighting source and have a long lifespan but also directly converts electric power into light energy, they consume low electricity and also shows a high efficiency.

Since technological development of lighting installations, the lighting is used in unprecedented and various ways such as cheering tools or media façade lighting for outputting a specific images on an outer wall of a building.

SUMMARY

In accordance with some embodiments, there is provided a system for controlling light in a wireless manner is disclosed. In some embodiments, the system includes a plurality of lighting installations containing a control module configured to control a lighting's status and an input module configured to input a command to the control module, and a control device configured to control the lighting installations by wireless communication via a plurality of communication channels with the lighting installations, wherein the control module operates as either a first mode that it is controlled by the control device during a connection status for communication with the control device or a second mode that it is controlled by the input module independently from the control device during a disconnection status for communication with the control device, the control device controls the plurality of lighting installations in accordance with lighting patterns by an input among a plurality of the lighting patterns, and the plurality of lighting installations contains a first lighting installation and a second lighting installation, and the first lighting installation controls the second lighting installation by sending signals through the command to the control device, the input module of the first lighting installation contains an accelerometer sensor, inputs the command through a three-dimensional motion and the plurality of lighting installations displays lighting patterns corresponding to the command, and the lighting installation further contains a plurality of lamps and, when a specific round trip pattern is detected by the accelerometer sensor, controls the plurality of lamps and outputs a specific image.

DETAILED DESCRIPTION

A system for controlling light in a wireless manner will be described more fully hereinafter with reference to the accompanying drawing, in which some embodiments are shown. Advantages and features of some embodiments accomplishing the same are hereafter detailed with reference to the accompanying drawings. The method for predicting a plant health status, and the computer-readable storage medium in which a program for performing the method is stored are embodied in different forms and should not be construed as limited to the embodiments set forth herein. Rather, these embodiments are provided so that this disclosure will be thorough and complete, and will fully convey the scope of the electrical brain stimulation system to those skilled in the art. The same reference numbers indicate the same component throughout the specification.

Unless defined otherwise, all technical and scientific terms used herein have the same meaning as commonly understood by one of ordinary skill in the art to which this application belongs. It is noted that the use of any and all examples, or exemplary terms provided herein is intended merely to better illuminate the electrical brain stimulation system and is not a limitation on the scope of the electrical brain stimulation system unless otherwise specified. Further, unless defined otherwise, all terms defined in generally used dictionaries may not be overly interpreted.

The use of the terms "a" and "an" and "the" and similar referents in the context of describing the electrical brain stimulation system (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

A detailed description of the system for controlling light in a wireless manner is hereafter presented with reference to the accompanying drawings.

Figure 1:
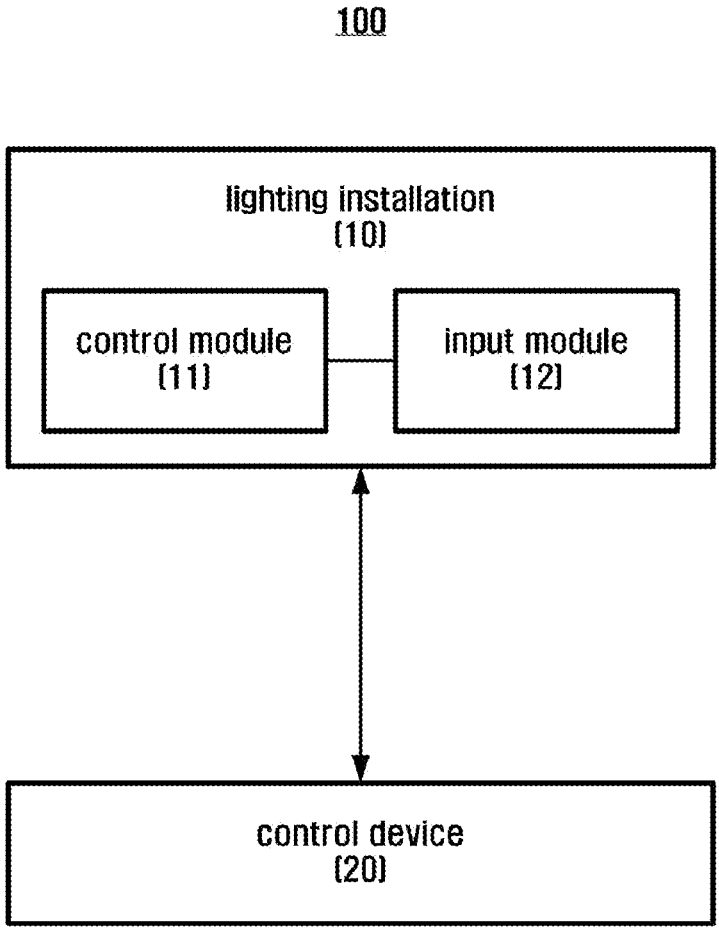
FIG. 1 is a schematic block diagram that roughly illustrates a composition of a system for controlling light in a wireless manner.

FIG. 1 illustrates a composition of a system for controlling light in a wireless manner. The system 100 for controlling light in a wireless manner in this embodiment includes a lighting installation 10 and a control device 20, wherein the lighting installation 10 includes a control module 11 and an input module 12 for inputting a command into the control module 11.

Herein, the term module in this embodiment means a software or a hardware component such as a field-programmable gate array (FPGA) or an application-specific integrated circuit (ASIC) according to its functionality, and the module performs a certain role. However, that module is not limited to a software or a hardware. In some embodiments, a module is arranged at a storage medium available for addressing, or it is composed to activate one or more processors.

In some embodiments, a lighting installation 10 is furnished with a plural number, and the shape of the lighting installation 10 has no limitation. For example, the lighting installation 10 is a stick-type or bar-type one that a user is able to hold with his or her finger, or is a wearable-type one that is wearable on a body part such as a wrist or a head.

Various source of light of colors such as red (R), green (G) and blue (B) is realized as a module for the source of color so that each lighting installation 10 realizes various colors.

A control module 11 controls each lighting's status, for instance, it controls a status for the brightness, color and turning-on/off of a lighting installation. When the control module 11 receives a specific pattern or imaging data from a control device 20, a plurality of lighting installations 10 is successively turned on and forms a specific image.

For an example, a control module 11 includes a DMX512 controller and autonomously controls a lighting installation 10. Also, Such controllers are included to a control device 20 and they control a plurality of lighting installations 10.

Figure 2:
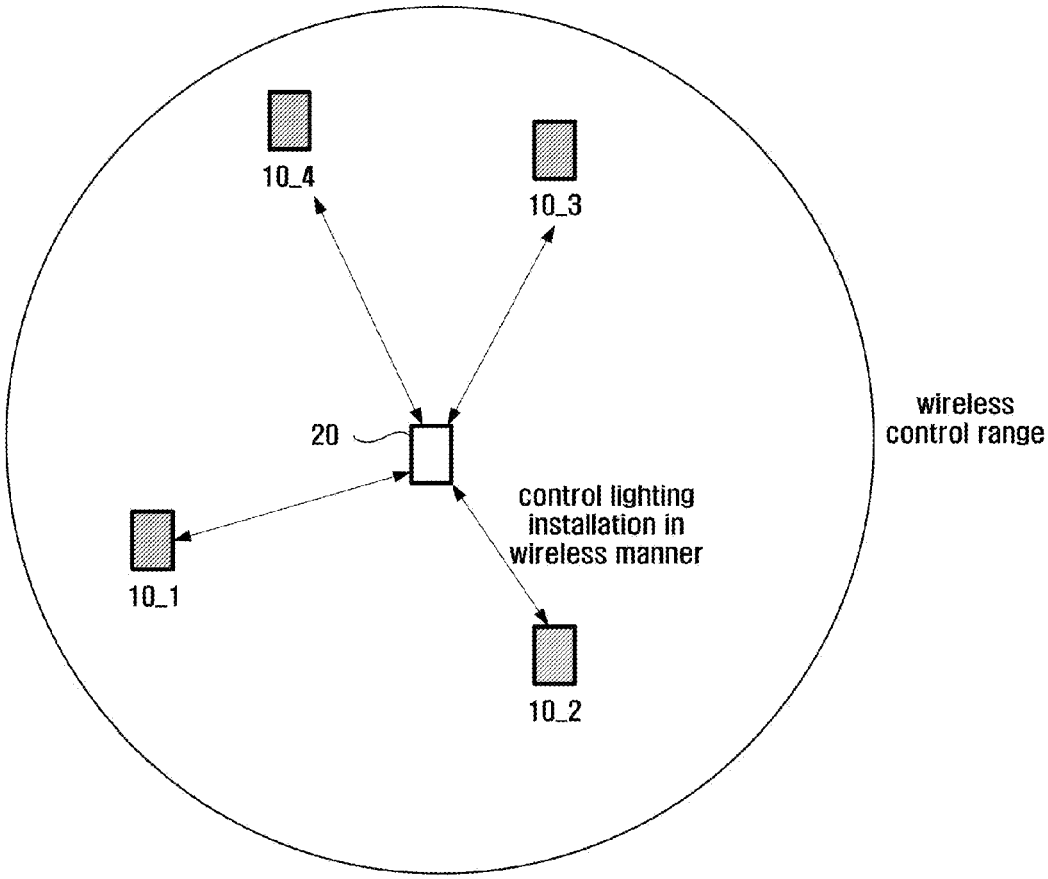
FIG. 2 is a schematic drawing that illustrates a structure of the system for controlling light in a wireless manner.

As shown in FIG. 2, a control module 11 operates as either a first mode that it is controlled by the control device during a connection status for communication with the control device or a second mode that it is controlled by the input module independently from the control device during a disconnection status for communication with the control device. In other words, being connected to a control module 11 of a plurality of lighting installations so as to control the whole lighting installations 10 at the same time, a control device 20 outputs a specific image or creates a specific pattern, design or message, and displays it as a mass game form. Herein, a control device 20 inputs either a plurality of lighting patterns and controls a plurality of lighting installations 10 so as to realize a specific image.

For an example, a control device 20 for controlling a plurality of lighting installations 10 in the first mode receives imaging data from a line driver or an input device, decides whether a communication protocol is an imaging data packet or an imaging data latch packet and, if it is an imaging data packet, transmits the data previously received to a plurality of lighting installations 10, and the data newly received is inputted into a shift register so that the imaging data that is pushed out is transmitted to the next order of a plurality of lighting installations 10 and the image is successively outputted. When all imaging data is transmitted to the lighting installations 10, a data latch packet is received and a plurality of lighting installations 10 mixes the received data as the red-green-blue (RGB) color so as to output a color value. For an instance, imaging data is presented with a color value, and a function of the brightness is controlled by pulse-width modulation (PWM).

For this purpose, a control device 20 includes a controller that displays an image by using a converter that transforms an SD card or DVI input into a DMX512 so as to create imaging data, or it chooses an image stored in an internal storage using RGB output, DVI, SD or Ethernet and transmits it to a lighting installations 10, or it chooses a preset lighting pattern and transmits it to a lighting installations 10.

Likewise, in a status where a control device 20 has a control power, an input module 12 of a lighting installations 10 is deactivated so that it does not operate. Meanwhile, when a second mode that is an independent mode is set, communication between the control device 20 and the control module 11 is disconnected, and by the input module 12 the lighting installation is controlled in accordance with each user's preset.

An input module 12 inputs a command into a control module 11 so as to control a lighting status individually. The input module 12 is button-type or switch-type, and it contains a touch panel so that it performs more sophisticated and various controls.

Figure 3:
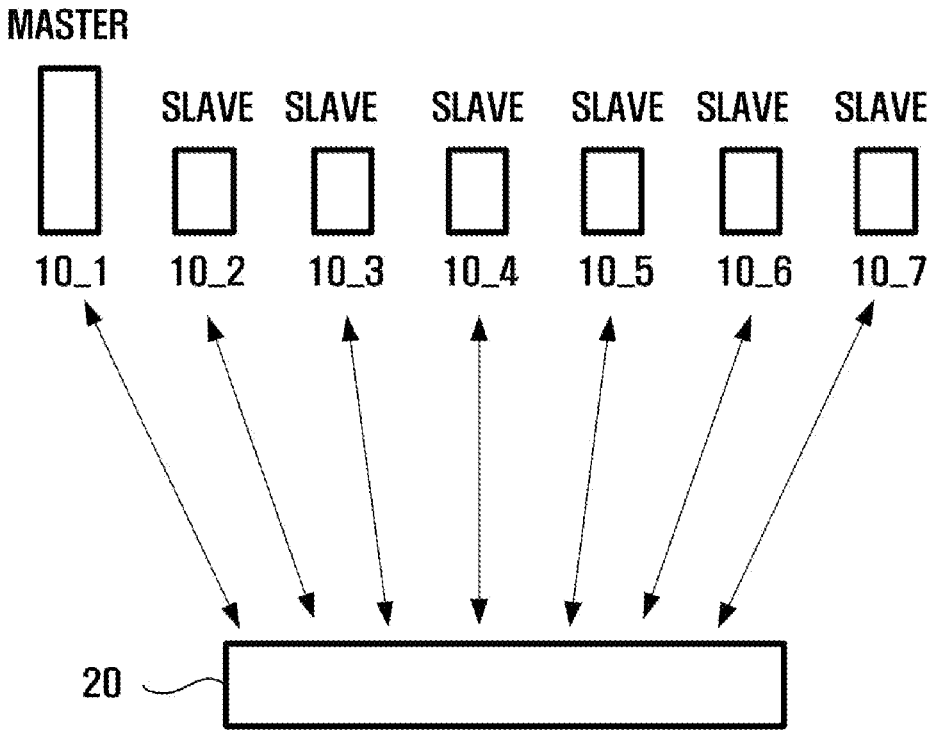
FIGS. 3 through 5 are drawings that illustrate motions of a system for controlling light in a wireless manner.

With reference to FIG. 3, an input module 12 in another embodiment includes an accelerometer sensor and inputs a command for a lighting control through a three-dimensional motion. For an example, a plurality of lighting installations 10 contains a first lighting installation 10_1, or MASTER, and a second lighting installation 10_2, 10_3, 10_4, 10_5, 10_6 and 10_7, or SLAVE, wherein the first lighting installation MASTER controls the second lighting installation SLAVE by transmitting signals to a control device 20 through a command input. That is, an authorized manager manages the other second lighting installation SLAVE through the first lighting installation or realizes a pattern he or she wants. The first lighting installation MASTER and the second lighting installation SLAVE communicate indirectly with each other or directly via an ad hoc network.

For an instance, an input method for a three-dimensional motion is a method of detecting a command in accordance with the correspondence between a motion detected by a tri-axial accelerometer a preset motion, or a three-dimensional motion inputted by a user is recognized and is mapped to two-dimensional space so that the images the user inputs are realized as they are.

In another embodiment, a lighting installation 10 further contains a plurality of lamps and, when a specific round trip pattern is detected by an accelerometer sensor, controls the plurality of lamps and, using afterimages, outputs a specific image. That is, if a user shakes a bar-type lighting installation 10 from side to side repeatedly, the accelerometer sensor recognizes the round trip pattern and outputs an image through afterimages. Specifically, a lighting installation 10 contains a lamp able to display texts or images, for example, an LED element, and by selectively turning on lamps in a specific location, it displays texts or images a user wants to display. Herein, either the whole text is displayed on the whole area of the lighting installation 10 or, if the area is not enough to display the whole text, it is split and is consecutively and successively displayed with a specific interval. In this case, by an afterimage effect, letters are displayed within the range of a round trip on the lighting installation 10. For instance, the interval is 30 milliseconds (ms) and the letters in a text are consecutively displayed, but the description is not limited to this, and an interval by frame is controllable in accordance with a velocity of round trip by measuring a velocity or an acceleration of a round trip pattern. In other words, if a round trip of the lighting installation 10 becomes fast, the interval by frame is shortened, and if it becomes slow, the interval by frame is lengthened.

Furthermore, by detecting the size, strength or the repetition number of a round trip pattern, the brightness of a lamp or size of an image is controlled. That is, when a user more intensely shakes a lighting installation 10 the image becomes brighter and bigger, but the description is not limited to this explanation.

Figure 4:
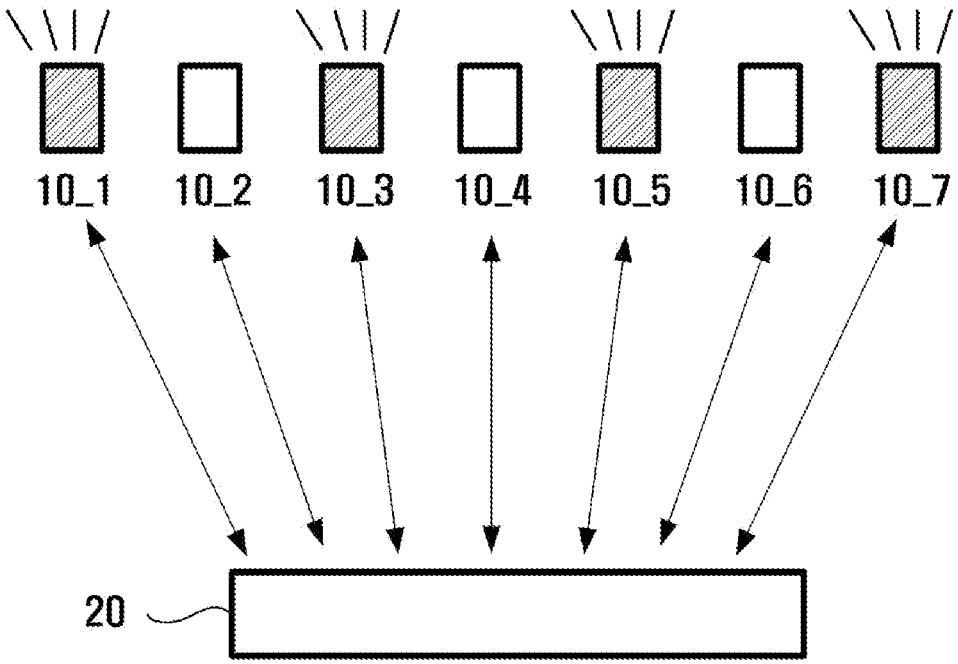
Figure 5:
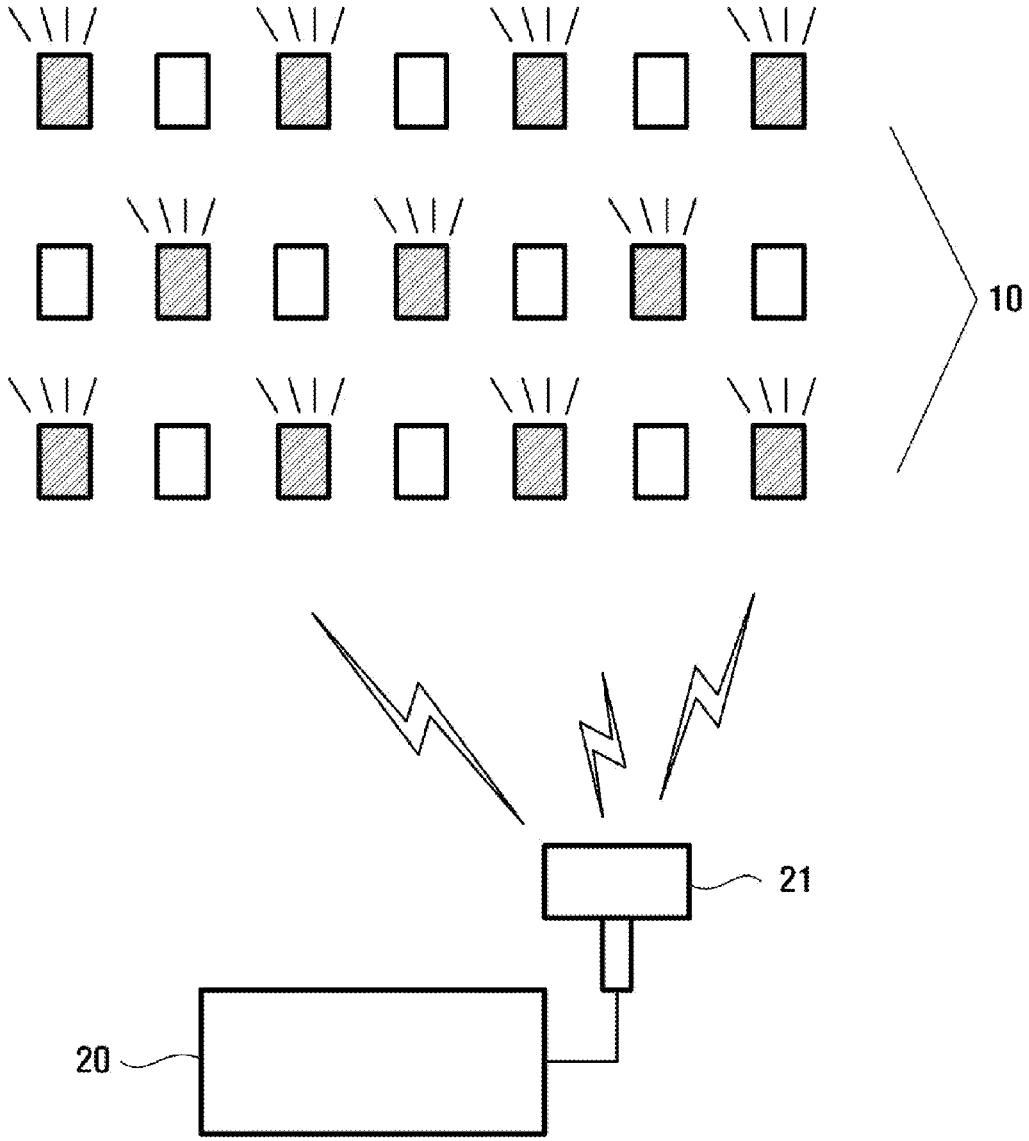

With reference to FIG. 4 and FIG. 5, a control device 20 digitalizes lighting patterns that are internally saved and an input image to realize, and scale down to the number a user decided, and each imaging data is transmitted by an SPI communication. Herein, a line driver is contained within the control device 20, and the line driver performs a buffering of the received imaging data so as to transmit the imaging data with a synchronized signal.

Likewise, a control device 20 performs a distribution of images, and each lighting installation 10 contains a protection circuit for a power supply, overvoltage, inverse voltage and a short.

A control device 20 is used in various ways, and it contains, but is not limited to, mobile devices such as a PC-type server or a tablet PC able to transmit data to each other being connected by a network and all kinds of various means equipped with such mobile devices. For an example, a control device 20 includes all wired and wireless home electronics or communication devices that have a user' interface for connecting to a lighting installation 10 via the wireless Internet or the portable Internet. An example for the display composition of a control device 20 is hereafter described further with reference to FIG. 8.

As illustrated, a control device 20 wirelessly controls a plurality of lighting installations 10 in a remote distance. Each lighting installation 10 is independently controlled, and by combining turning-on, turning-off, brightness, color, it represents a specific lighting pattern, images or videos.

For this end, a control device 20 further contains a multi-channel communication antenna module 21 that communicates using a plurality of wireless communication channels. A multi-channel communication antenna module 21 communicates with a lighting installation 10 via a plurality of frequency channel, for an example, five frequency channels, and it uses a Zigbee standard protocol.

Zigbee is a radio communication protocol for individual area where connection of peripheral devices that operate in 868 MHz, 902-928 MHz and 2.4 GHz is done wirelessly. But, in some embodiments, by that a multi-channel communication antenna module 21 is adopted as a directional antenna, it has a transmission range of at most 2 kilometers (km). Also, a telepathic translator is equipped between a control device 20 and a lighting installation 10 so as to expand a transmission range for wireless control signals.

Figure 6:
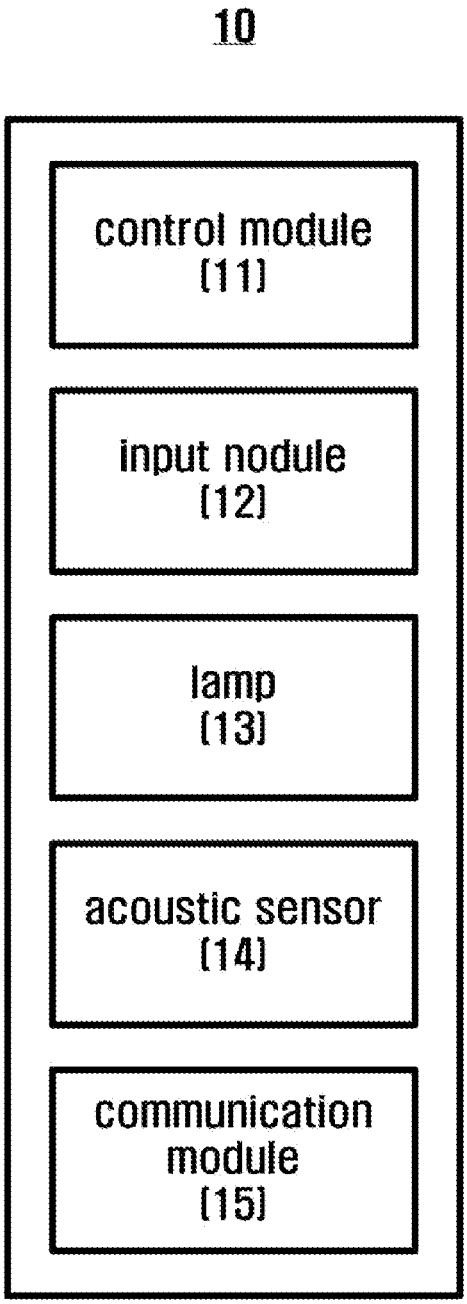
FIG. 6 is a schematic block diagram that illustrates a composition of lighting installations of a system for controlling light in a wireless manner in some embodiments.

FIG. 6 illustrates a composition of lighting installations of a system for controlling light in a wireless manner in another embodiment. A lighting installation 10 in this embodiment contains a control module 11, an input nodule 12, a lamp 13, an acoustic sensor 14 and a communication module 15.

A communication module 14 transceives data being connected with an input module 12, and an acoustic sensor 14 is contained within the input module 12. An acoustic sensor 14 detects external sound, a lighting device 10 automatically controls a status of a lighting in accordance with external sound. That is, in an environment such as a concert hall where external sound occurs loudly, brightness of a lighting installation is set to increase or decrease.

A lighting device 10 contains a communication module 15, wherein the communication module is composed to perform multi-channel communication with a multi-channel communication antenna module 21. By that an RF communication module is arranged in an array type with a plural number, for an example, five, the communication module 15 wirelessly communicates with a control device 20 in a remote distance via a plurality of communication channels. By transmitting the same data repeatedly via a plurality of communication channels, data integrity is secured, and reliability and stability are improved.

Figure 7:
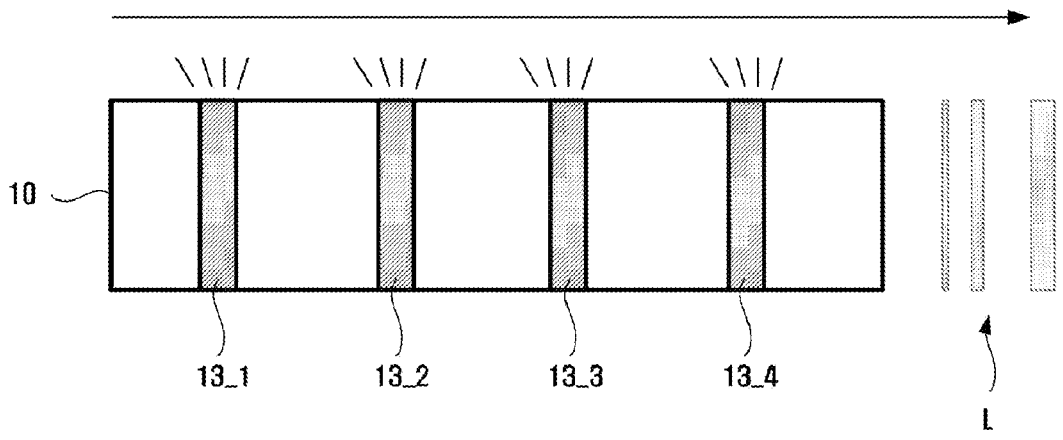
FIG. 7 is a schematic drawing that illustrates a composition of lighting installations of a system for controlling light in a wireless manner in another embodiment.

FIG. 7 is a schematic drawing that illustrates a composition of lighting installations of a system for controlling light in a wireless manner in another embodiment.

A lighting installation 10 in this embodiment is a bar-type lighting installation that has a lengthy shape to a unilateral side and further contains a plurality of lamps 13_1, 13_2, 13_3 and 13_4 consecutively arranged in accordance with a longitudinal direction, and the plurality of lamps forms a specific irradiating pattern L by a successive turning-on of from an end to the other end. For instance, an irradiating pattern L has a various shape such as a circle or a star, whereas lamps are turned on successively from an end (left side in FIG. 7) to the other end (right side in FIG. 7) so as to represent an advance or a retreat of lighting images.

Figure 8:
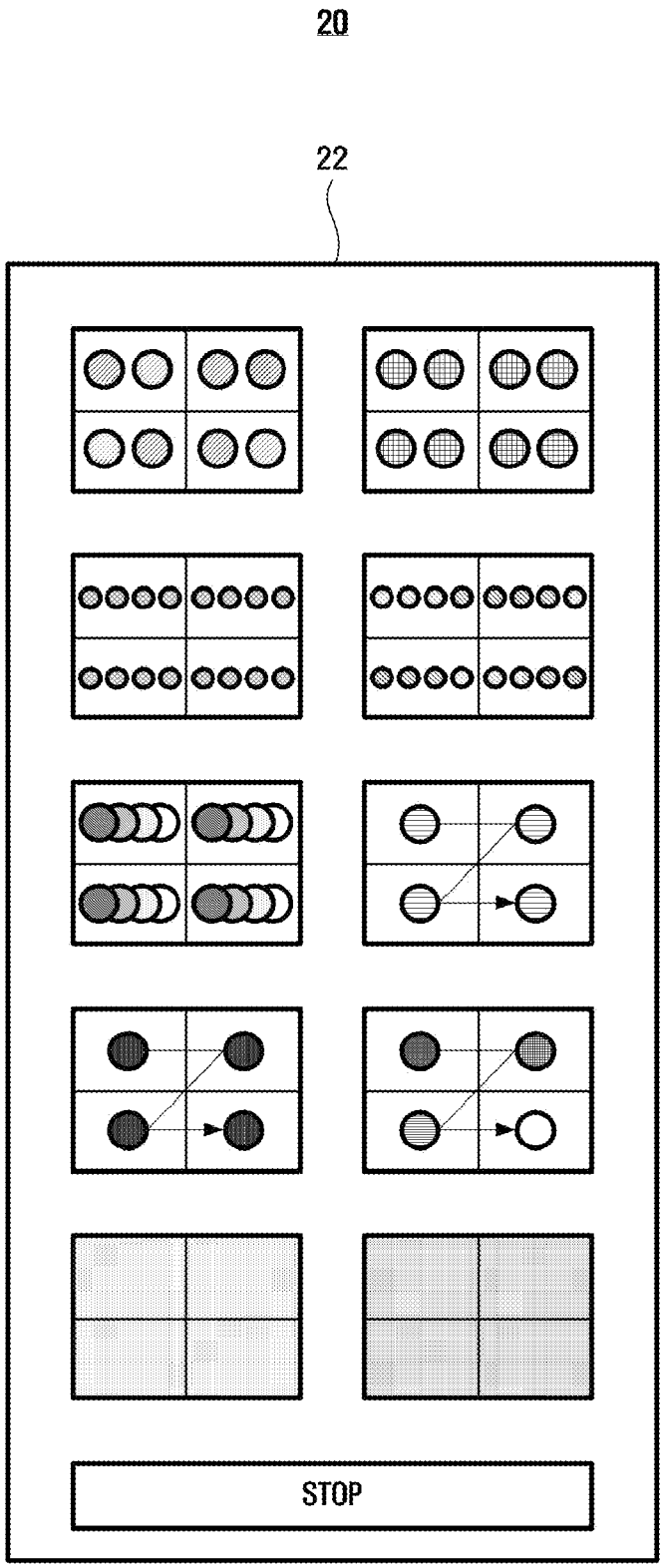
FIG. 8 is a schematic drawing that illustrates a composition of a control device of a system for controlling light in a wireless manner in yet another embodiment.

As shown in FIG. 8, a composition of a control device of a system for controlling light in a wireless manner in yet another embodiment is illustrated. A display on a control device 20 displays a variety of preset lighting patterns. When an administrator selects a lighting pattern on the display 22 of the control device 20, the control device 20 transmits to a plurality of the connected lighting installations 10 so as to realize the selected lighting pattern on a real lighting installation 10. Colors or shapes are freely chosen, or as described above, videos are downscaled so as to output images a user wants to display on the lighting installation 10.

In concluding the detailed description, those skilled in the art will appreciate that many variations and modifications can be made to the preferred embodiments without substantially departing from the principles of the some embodiments described above. Therefore, the described some embodiments are used in a generic and descriptive sense only and not for purposes of limitation.

I claim:

1. A system for controlling light in a wireless manner, the system comprising:

a plurality of lighting installations containing a control module configured to control a lighting's status and an input module configured to input a command to the control module; and a control device configured to control the lighting installations by wireless communication via a plurality of communication channels with the lighting installations;

wherein the control module operates as either a first mode that it is controlled by the control device during a connection status for communication with the control device or a second mode that it is controlled by the input module independently from the control device during a disconnection status for communication with the control device, the control device controls the plurality of lighting installations in accordance with lighting patterns by an input among a plurality of the lighting patterns, the plurality of lighting installations contains a first lighting installation and a second lighting installation, and the first lighting installation controls the second lighting installation by sending signals through the command to the control device, the input module of the first lighting installation contains an accelerometer sensor, inputs the command through a three-dimensional motion and the plurality of lighting installations displays lighting patterns corresponding to the command, and the lighting installation further contains a plurality of lamps and, when a specific round trip pattern is detected by the accelerometer sensor, controls the plurality of lamps and outputs a specific image.

2. The system of claim 1, wherein the input module further contains an acoustic sensor for detecting external sound, and the lighting installations, in accordance with the external sound, automatically control a status of the lighting.

3. The system of claim 1, wherein the lighting installations are bar-type, the lighting installations further contains a plurality of lamps arranged in a row in accordance with a longitudinal direction of the bar-type lighting installations, and the plurality of lamps is successively turned on from an end to the other end and forms a specific irradiating pattern.

4. The system of claim 1, wherein RF communication modules are arranged in an array type in the lighting installations so that the lighting installations communicate wirelessly via the plurality of communication channels.

* * * * *